US009765963B2

(12) United States Patent
Bertler et al.

(10) Patent No.: US 9,765,963 B2
(45) Date of Patent: Sep. 19, 2017

(54) VENT CAP FOR CHIMNEY RELINING SYSTEM

(71) Applicant: M&G DuraVent, Inc., Vacaville, CA (US)

(72) Inventors: Matthew L. Bertler, Vacaville, CA (US); Ryan L. Devine, Richmond, CA (US); Erik Pettitt, Sacramento, CA (US)

(73) Assignee: M&G DuraVent, Inc., Vacaville, CA (US)

( * ) Notice: Subject to any disclaimer, the term of this patent is extended or adjusted under 35 U.S.C. 154(b) by 1141 days.

(21) Appl. No.: 13/789,074

(22) Filed: Mar. 7, 2013

(65) Prior Publication Data

US 2014/0256242 A1 Sep. 11, 2014

(51) Int. Cl.
*F23L 17/02* (2006.01)

(52) U.S. Cl.
CPC ..... *F23L 17/02* (2013.01)

(58) Field of Classification Search
CPC ..... F23L 17/02; E04F 17/026; E04F 17/02; E04F 19/04; E04F 19/0481; F23J 13/02; F23J 2213/10; F24F 13/0281
USPC ..... 454/35–38, 44, 47, 12–14, 32
See application file for complete search history.

(56) References Cited

U.S. PATENT DOCUMENTS 1,328,647 A * 1/1920 Adolph ..... F23J 11/00 454/35
2004/0142652 A1* 7/2004 Hediger ..... F23J 13/025 454/12

* cited by examiner

*Primary Examiner* — Steven B McAllister
*Assistant Examiner* — Ko-Wei Lin
(74) *Attorney, Agent, or Firm* — Vierra Magen Marcus LLP

(57) ABSTRACT

A venting system includes a venting installation cap assembly for a venting system having at least an outer wall and an inner exhaust tube. The assembly includes an exhaust cap having an exhaust path coupled to the inner exhaust tube defined by a pipe section. A planar support ring having an annulus through which the pipe section passes rests on the outer tube or an adapter to the outer tube. The ring annulus surrounds the pipe section and has a diameter greater than a diameter of the outer wall. The planar support ring includes a plurality of airflow regions, surrounds the exhaust path and providing an airflow path between an exterior and a region between the outer wall and the inner exhaust tube.

19 Claims, 9 Drawing Sheets

SECTION 6 - 6

VENT CAP FOR CHIMNEY RELINING SYSTEM

BACKGROUND

Technology to re-line existing venting systems for combustive appliances and hearths has been used to prevent corruption of masonry chimneys. In recent years, construction of venting systems has been performed with existing chimney liners. Masonry chimneys and non-masonry chimneys now include a single or double wall chimney pipe coupled to the hearth or appliance.

In some such constructions, it is advantageous to re-line the original conduit with new and often superior re-lining material. Because the original construction terminates in an end cap, the original end cap will not generally work with a re-lined pipe.

SUMMARY

The technology, roughly described, includes a venting installation cap assembly for a venting system having at least an outer wall and an inner exhaust tube. The assembly includes an exhaust cap having an exhaust path coupled to the inner exhaust tube defined by a pipe section. A planar support ring having an annulus through which the pipe section passes rests on the outer tube or an adapter to the outer tube. The ring annulus surrounds the pipe section and has a diameter greater than the diameter of the outer wall. The planar support ring includes a plurality of airflow regions, surrounds the exhaust path and allows a free flow of air between the outer wall and the inner exhaust tube.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 2-11 depict a vent cap assembly in accordance with the present technology wherein:

FIG. 2 is a perspective view of the end cap assembly;

FIG. 3 is a side view of the end cap assembly.

FIG. 4 is a cross-sectional view along line 4-4 in FIG. 3;

FIG. 5 is an exploded view of the end cap assembly;

FIG. 6 is a cross-sectional view along line 6-6 in FIG. 5.

FIG. 7 is a second side view of the end cap assembly.

FIG. 8 is a partial, cross-sectional view along line 8-8 in FIG. 7.

FIG. 9 is a partial perspective view.

FIG. 10 is a partial, perspective exploded view.

FIG. 11 is a partial perspective view of the rigid pipe.

DETAILED DESCRIPTION

Technology is presented enabling a venting installation to be relined with a retrofitted tubing, while maintaining the existing chimney installation. The venting installation cap assembly finds use in a venting system having at least an outer wall and an inner exhaust tube. The assembly includes an exhaust cap having an exhaust path coupled to the inner exhaust tube defined by a pipe section. A planar support ring having an annulus through which the pipe section passes rests on the outer tube or an adapter to the outer tube. The ring annulus surrounds the pipe section and has a diameter greater than the diameter of the outer wall. The planar support ring includes a plurality of airflow regions, surrounds the exhaust path and provides a free flow of air between the outer wall and the inner exhaust tube.

Figure 1:
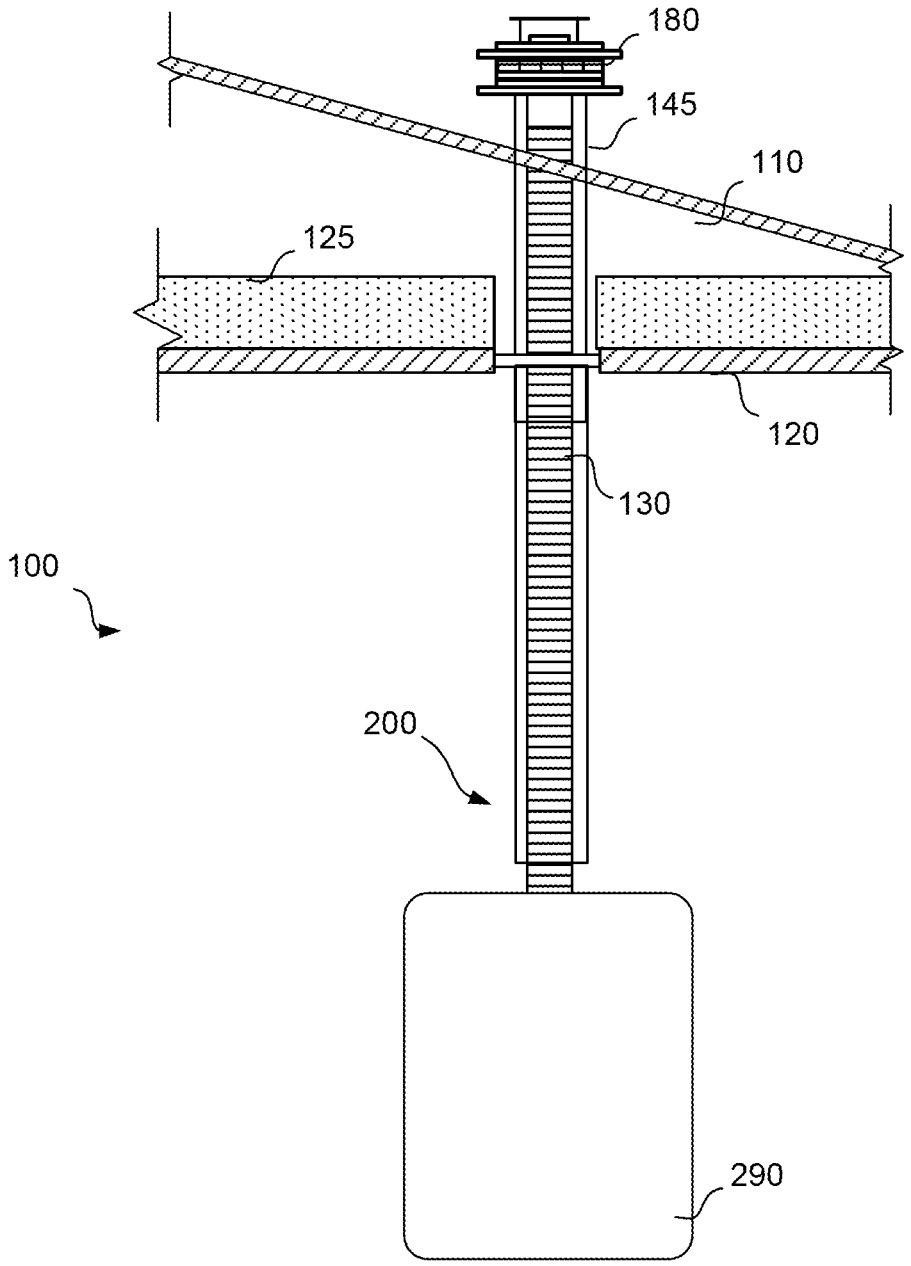
FIG. 1 depicts a relined venting system.
Figure 3:
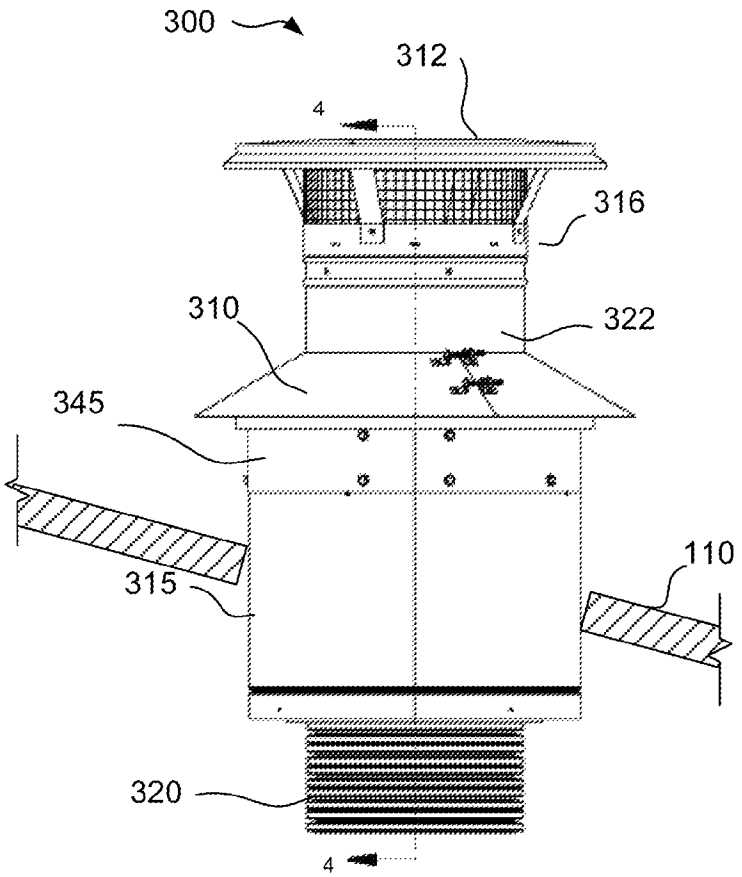

FIG. 1 depicts a relined chimney system 100 coupled an appliance or hearth 290. The relined system may be comprised of single or double walled vent pipe comprising one or more pieces 145, 200 passing through a ceiling 120 and roof 110. The venting system 100 may be any single or double walled pipe to be provided through any combustibles such as ceiling insulation 125, ceiling material 120 or roofing material 110. The vent system terminates in a vent cap 180 on the exterior of a building. Generally the vent system 100 and specifically piece 145 is sized to couple directly to the vent cap 180.

FIGS. 2-11 illustrates the present technology of a vent cap assembly 300 suitable for use with high-temperature relining systems. In accordance with the technology, a venting cap 316 is mounted on a pipe 322 for relining an existing chimney installation with a rigid or flexible reliner is shown. In the present description, a flexible reliner is illustrated. The vent cap assembly is illustrated herein in conjunction with an existing chimney structure (315,325) and relining material (320).

A vent cap assembly 300 includes a cap 316, storm collar 310, pipe 322, support ring 330, support bracket 340, centering bracket 335, flex adapter 355 and adjustable ring 345. Cap 316 includes a cylindrical wire mesh **316*a* capped by plate 312, the mesh 316*a* forms a barrier through which exhaust 405 from an appliance or hearth 290 (FIG. 4**) are allowed to pass.

Figure 2:
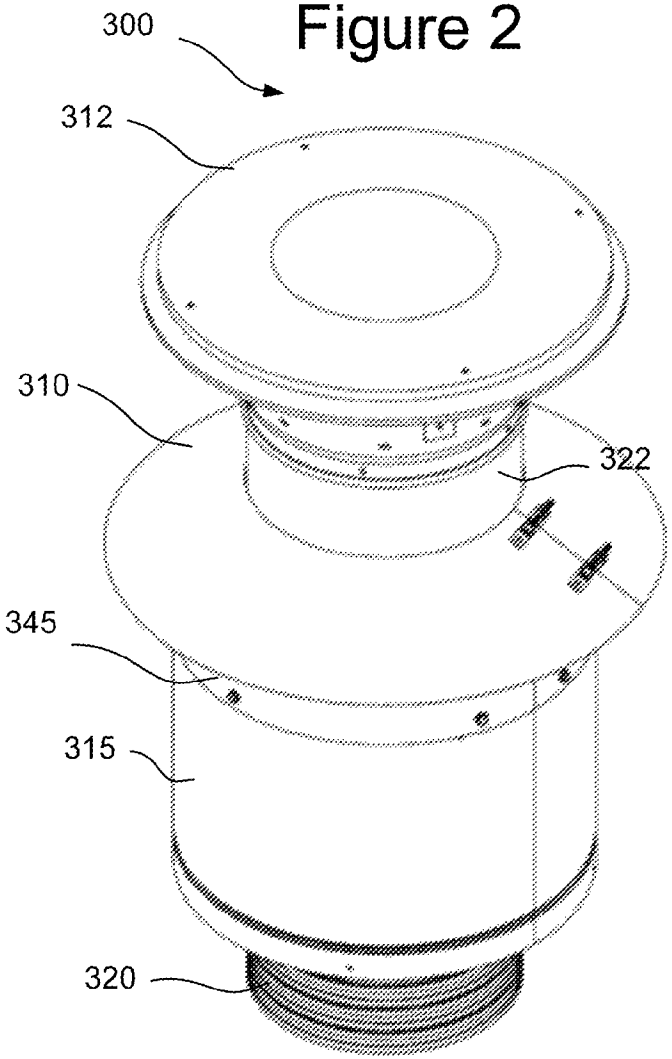

A vent cap assembly 300 provides for exhaust from the appliance 290 while providing air flow through an annular region 400 between the outer chimney 315 and inner chimney 325 walls or between the liner 320 and the outer chimney wall if no inner chimney wall 325 is used. The vent cap assembly 300 is detailed further below. As illustrated in FIG. 2, the vent cap assembly is provided on the exterior of a structure, such as the exterior of a roof 110.

Generally outer chimney wall 315 and inner chimney wall 325 form a portion of an existing installation through which a relining vent tube 320 is routed. The vent tube 320 may be rigid, or flexible as illustrated. In one embodiment, no inner chimney wall 325 is utilized with the present technology.

Internal vent tube 320, in one embodiment, comprises a flexible venting material comprising a heat and/or corrosive resistant material. Material which is suitable for use in such systems includes stainless steel. Commercial products suitable for use as vent material 320 include varieties of Type 304, 316, 441, 446, 447, 448, stainless steels. Very high temperature polymeric materials may also be used as the tube 320 in alternative embodiments.

The venting material 320 is snaked through the existing system or uses additional relining components, using the existing chimney as a chase until the lead end of the material reaches the end of the vent system near an existing vent cap.

Vent material 320 is comprised of a vent material having a diameter or cross-section suitably sized to fit within all components of the inner wall 325. In embodiments where no inner wall is used, vent material 320 is suitably sized to fit within all components of an existing wall such as outer wall 315. In both such embodiments, air flow is allowed between the vent material 320 and the inner wall 325 or outer wall 315. If air flow is possible between the appliance end and structure exterior end between the inner wall 315 and outer wall 325, such flow should not be restricted.

The inner chimney wall 325 and outer chimney wall 315 form an existing installation in a dwelling or other structure. An inner liner tube 320 is placed within the inner wall 325.

In this embodiment, to install the cap, the flex adapter 355 engages and receives the flex tube 320. It should be understood that the flex adapter 355 may be sized for various different sizes of internal chimney tubes 325. A rigid pipe 322 engages the flex adapter 355.

A centering bracket 335 may be attached to the flex adapter 355. Tabs 335*a* on the centering bracket align the position of the flex adapter and flex tube within the inner wall 325.

An adjustable band 345 engages outer wall 315 of the existing chimney.

Figure 8:
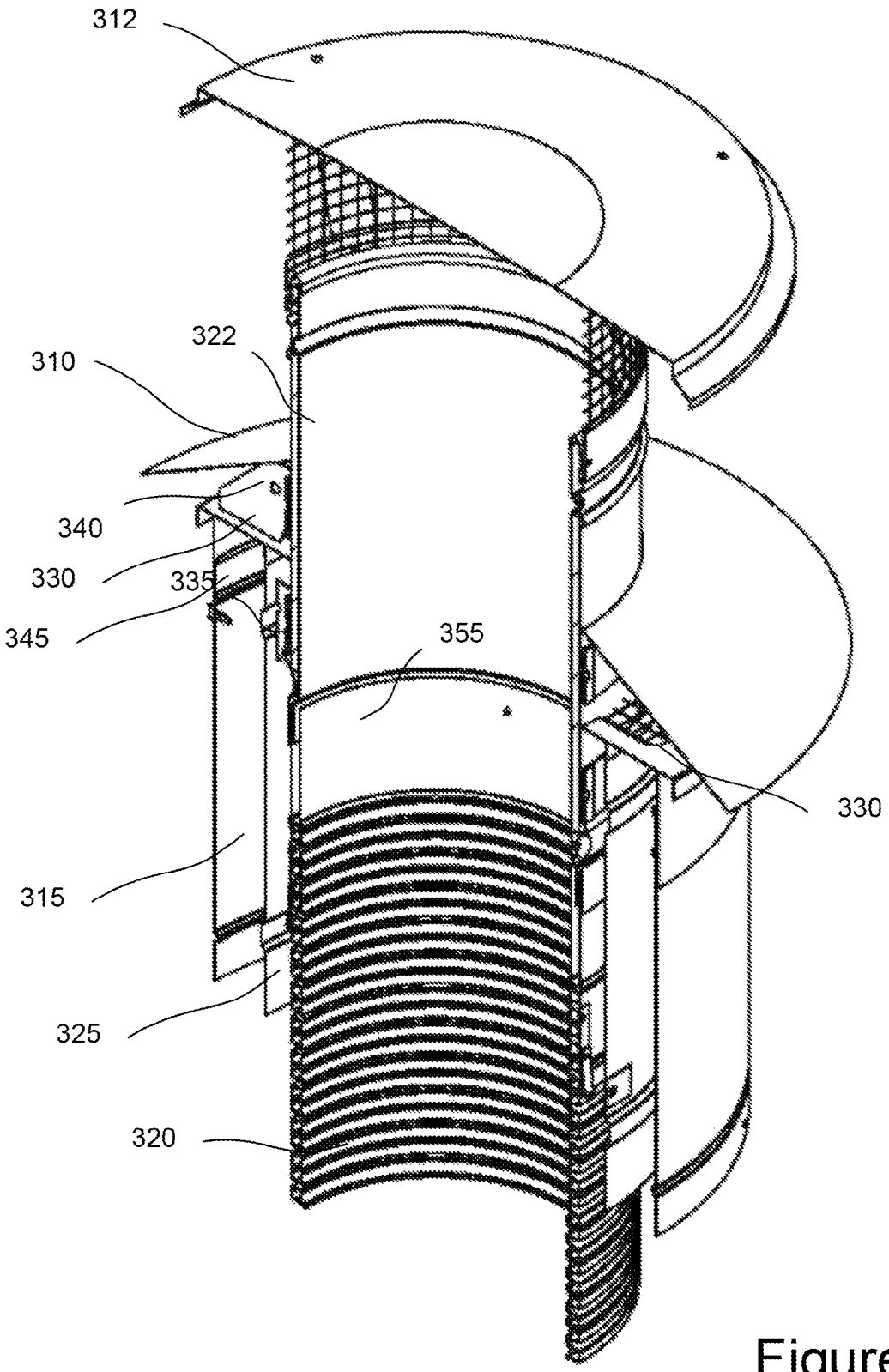
Figure 10:
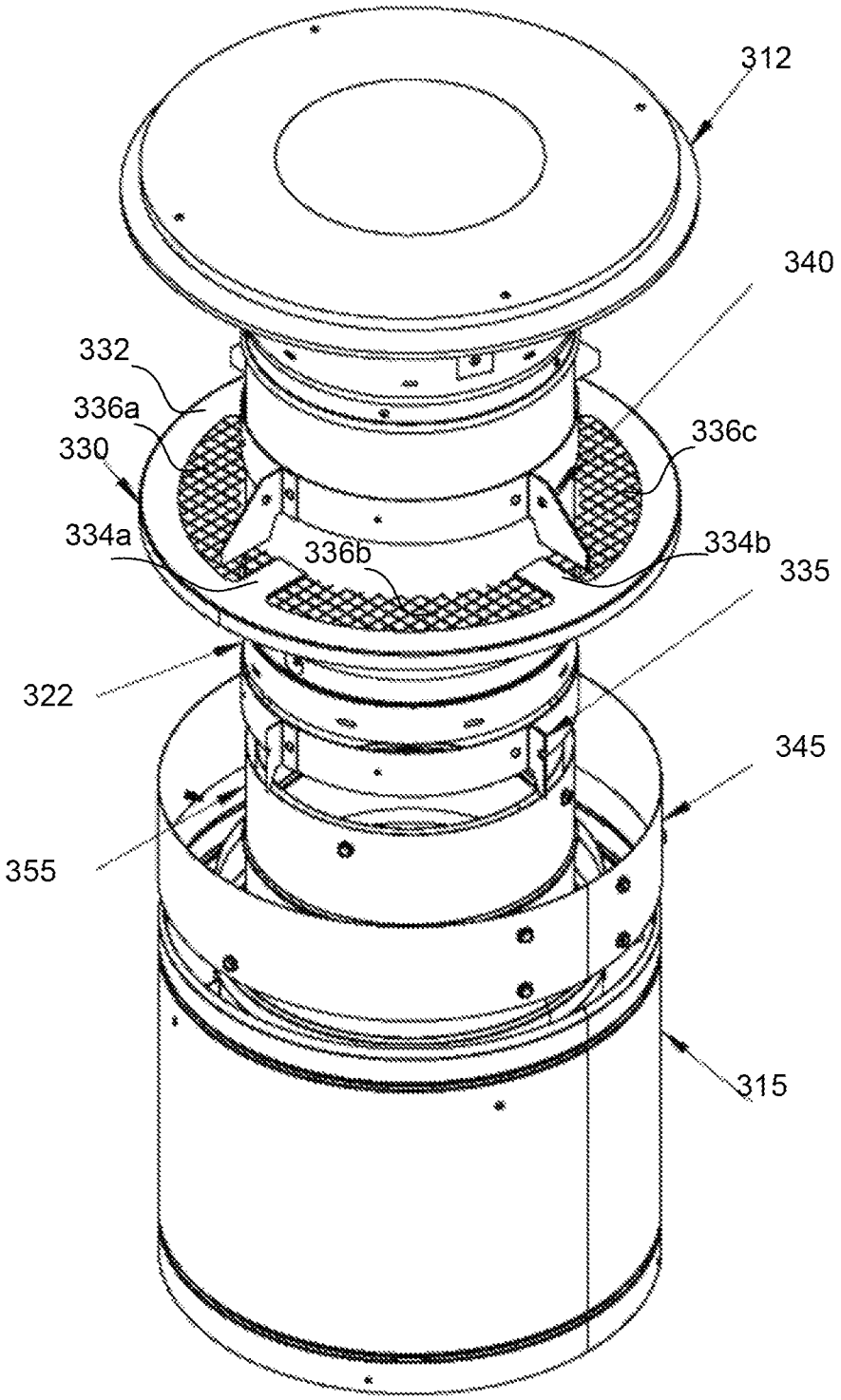
Figure 11:
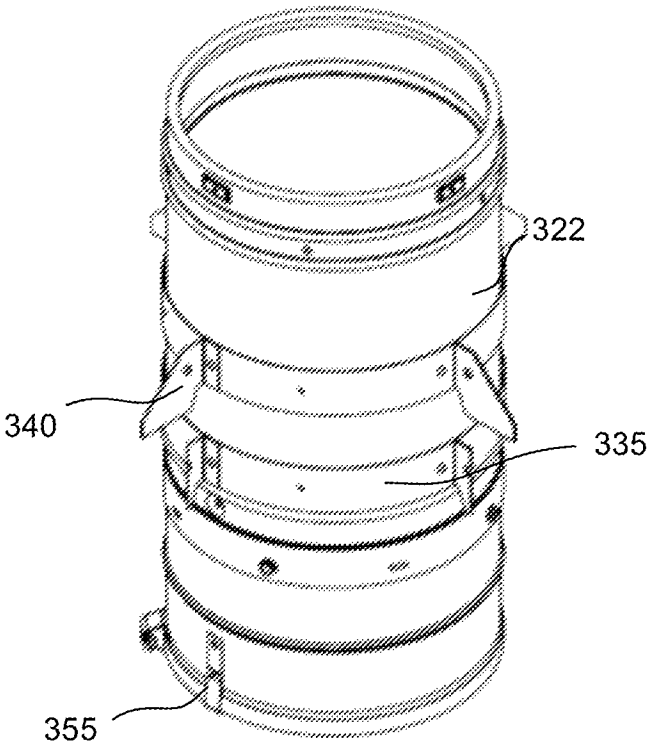
Figure 9:
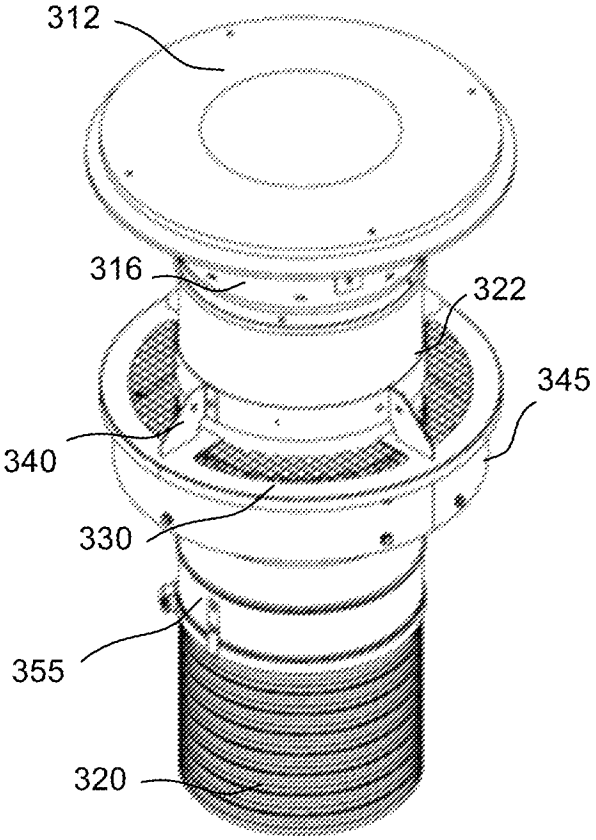

Resting on the adjustable band 345 is a support ring 330. The support ring 330 may rest on the outer wall 315 directly. Support ring 330 includes an outer ring 332, four spokes 334 (of which two-334*a* and 334*b*—are illustrated) and four mesh areas 336*a-c* (only three of which are illustrated) which allow air through from the annular region between walls 315 and 325. An inner ring defines an annulus which allows the rigid pipe 322 therethrough. The mesh screens form a flow path from the region 400 between the inner wall 325 and the outer wall 315 and to the exterior of a building or structure through the gap between the storm collar 310 and the outer wall 315. The storm collar includes a circumferential edge positioned a spaced distance apart from the outer wall forming a gap. Support ring 330 supports upper portions of the cap structure 300. Support ring 330 is generally planar in that all of components 332, 334, 336 and the annulus lie in a single plane. The ring 330 may include a flange 331 (FIG. 8).

The mesh regions are integrally formed between the spokes 334. Although four spokes and mesh regions are illustrated, one or more mesh regions and zero spokes may be utilized.

A support bracket 340 is fastened by any suitable means to rigid tube 322 and rests on support ring 330. Cap 316 including mesh region 316*a* and top cap 312 engages pipe 322, which engages adapter 355 and rests on support bracket 340 and ring 330. In one embodiment, the ring 330 is not fastened to the pipe 322, but includes an annulus or hole through which the pipe 322 extends. The support bracket 340 sits on the disk, and on the top of the pre-existing chimney 315/315 and/or the band 345, thereby providing structural support for the assembly.

Figure 4:
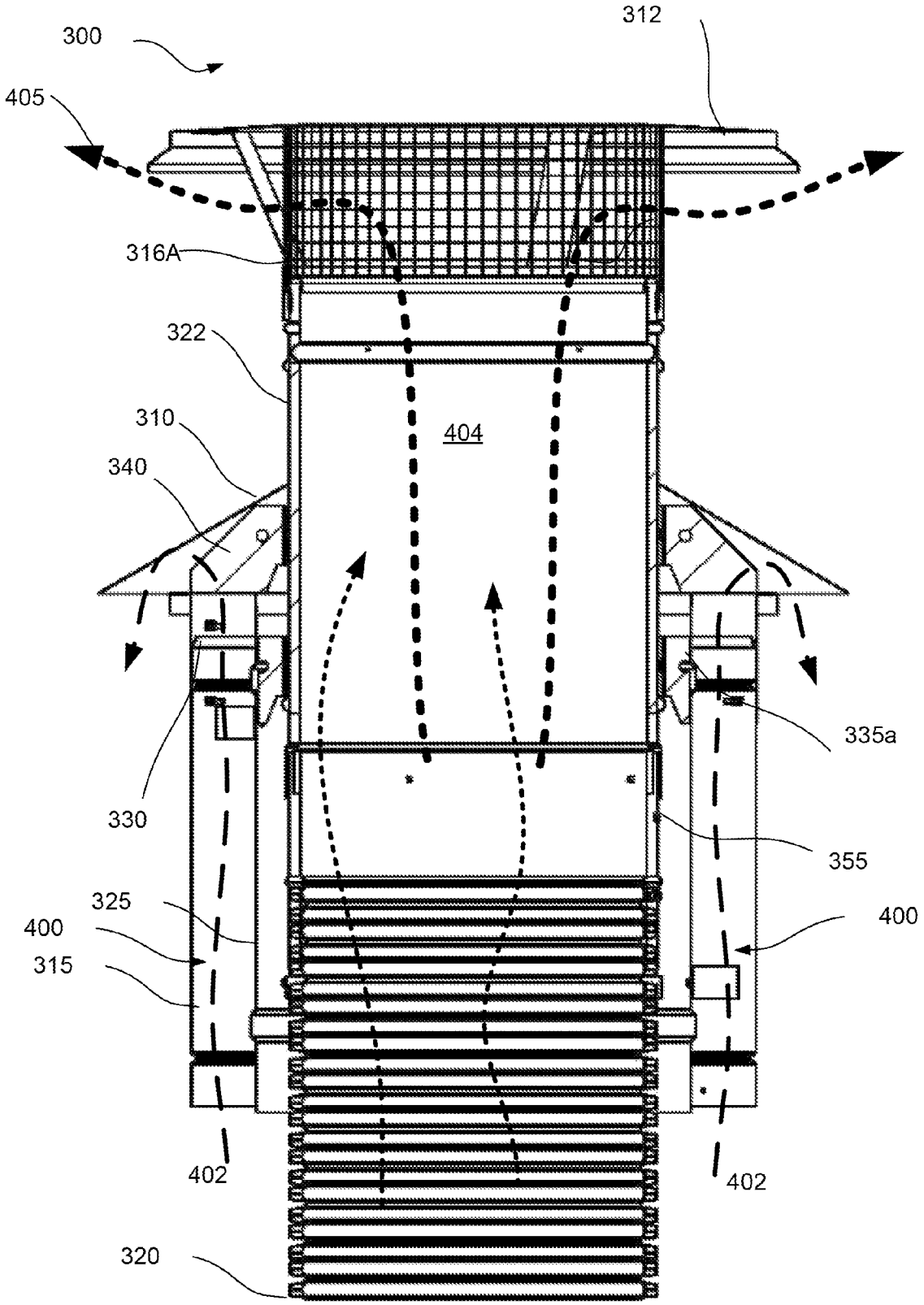
Figure 5:
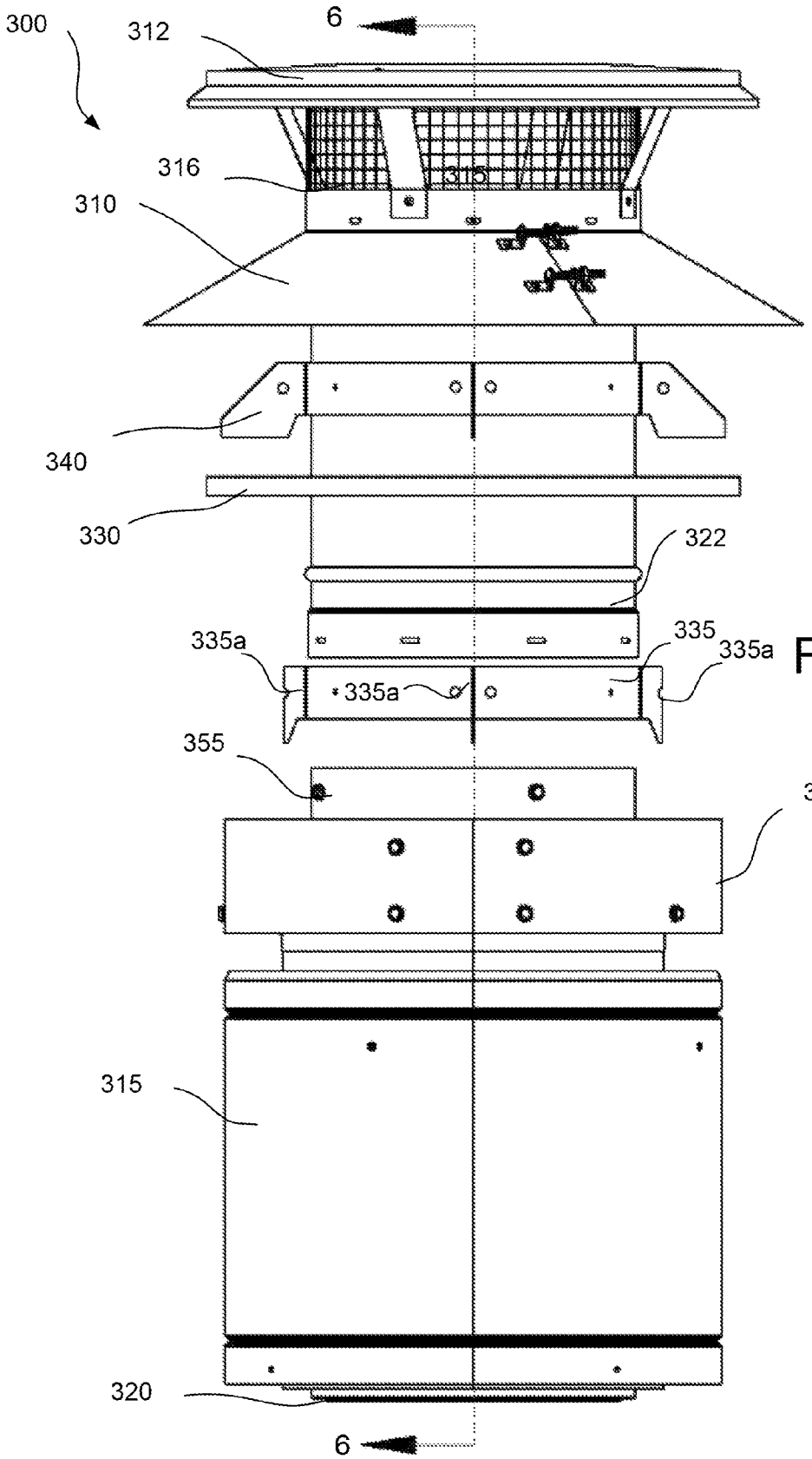
Figure 6:
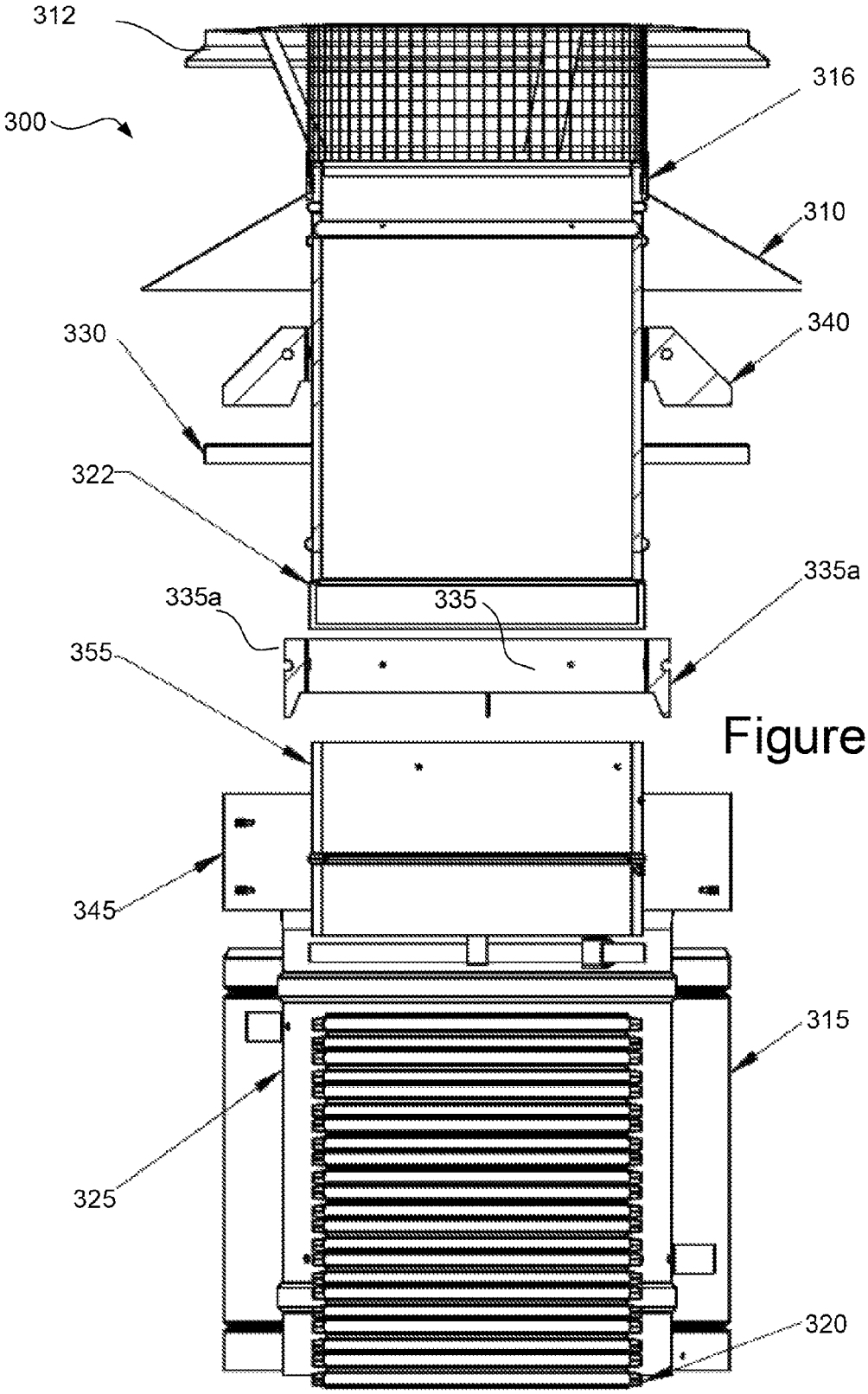
Figure 7:
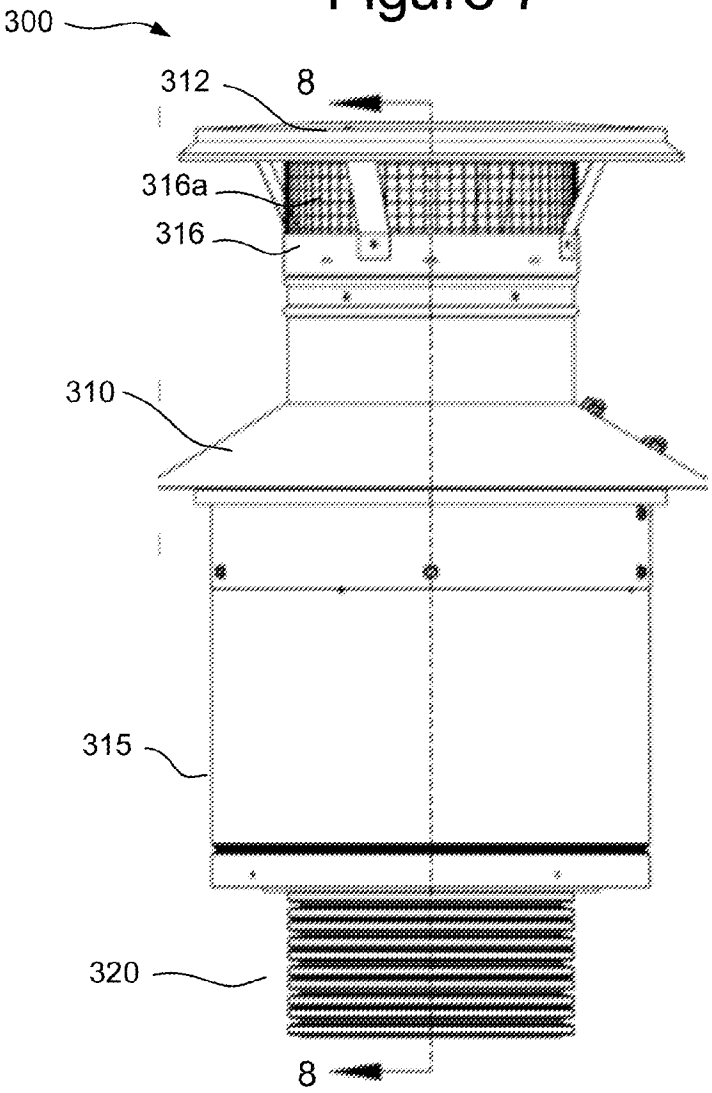

As illustrated in FIG. 4, airflow 402 is provided through the mesh regions 336 for the region 400, while exhaust for the appliance 404 exits through an exhaust flow path 404 formed by the flex tube 320, rigid pipe 322 and mesh regions 316*a*. Storm collar 310 is mounted to rigid pipe 322 and covers the flow path/mesh regions 336. It should be understood that the technology does not require a double wall existing chimney, and would be useful in installations where no inner wall 325 is present.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A venting cap system for use with a venting system having a flexible lining tube and a pre-existing vent structure, the flexible lining tube defining an exhaust path; comprising a cap having a first region coupled to the exhaust path, the cap including a pipe section defining a portion of the first region, the first region leading to an exhaust vent;

a planar support ring supporting below the cap and having an annular region allowing the pipe section therethrough, the annular region containing spokes extending radially away from the pipe section with mesh between the spokes thereby defining at least one mesh region, the planar support ring circumscribing the pipe section, the spokes and the mesh being in the same plane;

an flex adapter coupling the pipe section to the flexible lining tube, the flexible lining tube positioned within the pre-existing vent structure;

wherein the planar support ring is positioned such that the one or more mesh regions overlie a portion of a region between the flexible lining tube and the outer most diameter of the pre-existing vent structure thereby allowing exhaust from an appliance to pass through the first region and air flow between the flexible lining tube and pre-existing vent structure.

2. The cap of claim 1 wherein the cap further includes a centering bracket attached to the flex adapter and adapted to align the position of the flex adapter and flexible lining tube within the pre-existing vent structure.

3. The cap of claim 1 further including a support bracket coupled to the pipe section and resting on the planar support ring, the support bracket thereby supporting the cap and pipe section.

4. The cap of claim 1 further including a storm collar positioned over the one or more mesh regions, the storm collar circumscribing the pipe section.

5. The cap of claim 4 wherein the storm collar includes a circumferential edge positioned a spaced distance apart from the outer wall of the pre-existing vent structure.

6. A venting cap assembly for a venting system having at least an outer wall and an inner exhaust tube, comprising:

an exhaust cap having an exhaust path coupled to the inner exhaust tube, and the exhaust path defined by a pipe section; and a planar support ring having an annulus through which the pipe section passes, the planar support ring surrounding the pipe section and having a diameter greater than a diameter of the outer wall, the planar support ring including a plurality of spokes extending away from the pipe section thereby defining a plurality of airflow regions in the planar support ring, the airflow regions including a mesh between each of the plurality of spokes and covering each of the plurality of airflow regions, the mesh and the spokes lying in the same plane in the planar support ring and surrounding the exhaust path, and the plurality of airflow regions providing an airflow path between an exterior of a building and a region between the outer wall and the inner exhaust tube.

7. The cap of claim 6 wherein the inner exhaust tube is a flexible relining tube.

8. The cap of claim 7 further including a concentric inner wall positioned a spaced distance apart from the outer wall and surrounding the inner exhaust tube.

9. The cap of claim 8 further including a support bracket coupled to the pipe section and resting on the planar support ring, the support bracket thereby supporting the cap and pipe section.

10. The cap of claim 9 further including a rigid pipe surrounding the pipe section and a storm collar positioned over the airflow regions, the storm collar fastened to the rigid pipe.

11. The cap of claim 10 wherein the storm collar includes a circumferential edge positioned a spaced distance apart from the outer wall.

12. The cap of claim 6 further including flex adapter coupling the pipe second and a centering bracket attached to the flex adapter and, the centering bracket is adapted to align the position of the flex adapter and flexible lining tube within the pre-existing vent structure.

13. A venting assembly for use with a venting system having an inner exhaust tube surrounded by a concentric outer wall, the inner exhaust tube defining an exhaust path to an appliance; comprising a vent cap having a flow region coupled to the exhaust path, the flow region defined by a rigid pipe section defining a portion of the flow region and an exhaust output;

a planar support ring having an annulus through which the rigid pipe section passes, the planar support ring surrounding the rigid pipe section and having an outer diameter greater than a diameter of the outer wall, the planar support ring including at least one mesh-covered airflow region defined by a plurality of spokes extending radially from the annulus toward the outer diameter, the mesh and the spokes lying in the same plane, the planar support ring surrounding the exhaust path and the at least one airflow region providing a flow path coupled to a region between the outer wall and the inner exhaust tube, wherein the planar support ring is positioned such that the at least one airflow region overlies a region between the inner exhaust tube and the outer wall; and a support bracket resting on the planar support ring and fastened to the rigid pipe section.

14. The venting assembly of claim 13 wherein the inner exhaust tube is a flexible relining tube.

15. The venting assembly of claim 14 further including a concentric inner wall positioned a spaced distance apart from the outer wall and surrounding the inner exhaust tube.

16. The venting assembly of claim 13 further including a support bracket coupled to the rigid pipe section and resting on the planar support, the support bracket thereby supporting the cap and rigid pipe.

17. The venting assembly of claim 13 further including a storm collar positioned over the at least one airflow region, the storm collar fastened to the rigid pipe.

18. The venting assembly of claim 17 wherein the storm collar includes a circumferential edge positioned a spaced distance apart from the outer wall.

19. venting assembly of claim 14 further including a flex adapter coupling the rigid pipe section to the flexible relining tube and a centering bracket attached to the flex adapter and adapted to align the position of the flex adapter and flexible lining tube within the pre-existing vent structure.

* * * * *